US006658905B1

(12) United States Patent
Hsieh

(10) Patent No.: US 6,658,905 B1
(45) Date of Patent: Dec. 9, 2003

(54) REMOTE-CONTROLLED DOOR LOCK

(76) Inventor: Hui-Hua Hsieh, P.O. Box 90, Tainan City (TW)

( * ) Notice: Subject to any disclaimer, the term of this patent is extended or adjusted under 35 U.S.C. 154(b) by 0 days.

(21) Appl. No.: 10/197,424

(22) Filed: Jul. 18, 2002

(51) Int. Cl.[7] ..... E05B 47/00; E05B 59/00

(52) U.S. Cl. ..... 70/279.1; 70/256; 70/107; 70/280

(58) Field of Search ..... 70/107, 108, 257, 70/256, 280, 281, 282, 279.1; 292/144

(56) References Cited

U.S. PATENT DOCUMENTS 1,358,445 A * 11/1920 Hermanowich ..... 70/108
4,833,465 A * 5/1989 Abend et al. ..... 340/5.65
4,840,050 A * 6/1989 Gotanda ..... 70/107
4,929,003 A * 5/1990 McConnell ..... 292/144
5,626,039 A * 5/1997 Solari et al. ..... 70/279.1
5,636,880 A * 6/1997 Miller et al. ..... 292/144
5,790,034 A * 8/1998 Khoury ..... 340/5.64
5,852,944 A * 12/1998 Collard et al. ..... 70/278.7
5,987,818 A * 11/1999 Dabideen ..... 49/280
6,012,310 A * 1/2000 Hsiao ..... 70/278.2
6,112,563 A * 9/2000 Ramos ..... 70/278.1
6,381,999 B1 * 5/2002 Doong ..... 70/107

FOREIGN PATENT DOCUMENTS

GB 2196382 A * 4/1988

* cited by examiner

*Primary Examiner*—Anthony Knight
*Assistant Examiner*—Michael J. Kyle

(57) ABSTRACT

A remote-controlled door lock in the present invention has a case body provided with a battery base, a circuit board and a bolt-locking device therein. A bolt rod of the bolt-locking device can be actuated by the battery base and the circuit board under the control of a remote controller to extend out of a through hole of the case body to be inserted into and engaged with an engagement hole of a strike base installed in a door frame, thereby locking a door plate in a limited position. When the door plate is locked with the bolt rod still engaged with the engagement hole of the strike base, the door plate is unable to be completely unlocked only by a key without using the remote controller to actuate the bolt rod to be disengaged from the engagement hole of the strike base, thereby achieving a best effect of anti-theft.

1 Claim, 5 Drawing Sheets

REMOTE-CONTROLLED DOOR LOCK

BACKGROUND OF THE INVENTION

1. Field of the Invention

This invention relates to a remote-controlled door lock, particularly to one provided with a bolt-locking device capable of being controlled by a remote controller to extend a bolt rod of the bolt-locking device to be inserted into and engaged with an engagement hole of a strike base installed in a doorframe, thereby locking a doorplate in a limited position. When the door plate is locked with the bolt rod of the bolt-locking device still engaged with the engagement hole of the strike base, the door plate is unable to be completely unlocked only by a key without using the remote controller to actuate the bolt rod of the bolt-locking device to be disengaged from the engagement hole of the strike base, thus achieving a best effect of anti-theft.

2. Description of the Prior Art

A conventional key-operated door lock, as shown in FIG. 1, includes a case body 10 provided with a lock base 11, a pull plate 12 and a latch-bolt assembly 13 disposed therein. The lock base 11 has deadbolts 110 provided at one side thereof and capable of extending out of through holes 100 formed in a sidewall of the case body 10 to be inserted into and engaged with an elongated opening 141 formed in sidewall of a strike base 140 installed in a door frame 14. The lock base 11 further has two lock cores 111 respectively disposed in an inner and an outer sides thereof and each provided with a keyhole 112. The pull plate 12 is disposed in the inner side of the case body 10 and has a fixing plate 120 extending into a slide groove 101 of the case body 10 and attached relatively to a fixing plate 102 of the case body 10. One end of the latch-bolt assembly 13 extends through the fixing plate 102 of the case body 10 to be secured to the fixing plate 120 of the pull plate 12. A spring 130 is sleeved on the latch-bolt assembly 13 adjacent to the end thereof. The other end of the latch-bolt assembly 13 is provided with a stop member 131 capable of extending out of a through hole 103 formed in a sidewall of the case body 10 to be inserted into and engaged with the elongated opening 141 of the strike base 140. When a key is inserted in the keyhole 112 of one of the lock cores 111 to turn, the deadbolts 110 and the stop member 131 can be disengaged from the elongated opening 141 of the strike base 140, thus unlocking the conventional key-operated door lock.

However, such a conventional key-operated door lock only using a key to force the deadbolts 110 to be engaged with the elongated opening 141 the strike base 140 can be easily pried unlocked by thefts with simple picking tools or special tools, thus losing the anti-theft function.

SUMMARY OF THE INVENTION

The main purpose of the invention is to offer a remote-controlled door lock having a best effect of anti-theft.

The main feature of the invention is to provide a case body having a battery base, a circuit board and a bolt-locking device disposed therein, the bolt-locking device having a motor, a driving gear disposed at an upper end of the motor, a driven gear meshed with the driving gear, a transmission gear coaxially disposed below the driven gear, a gear rack meshed with the transmission gear, and a bolt rod disposed at a front portion of the gear rack and capable of extending out of a through hole formed in a sidewall of the case body; and, a strike base installed in a doorframe having an engagement hole formed in a sidewall thereof for corresponding in location to be aligned with the bolt rod of the bolt-locking device.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
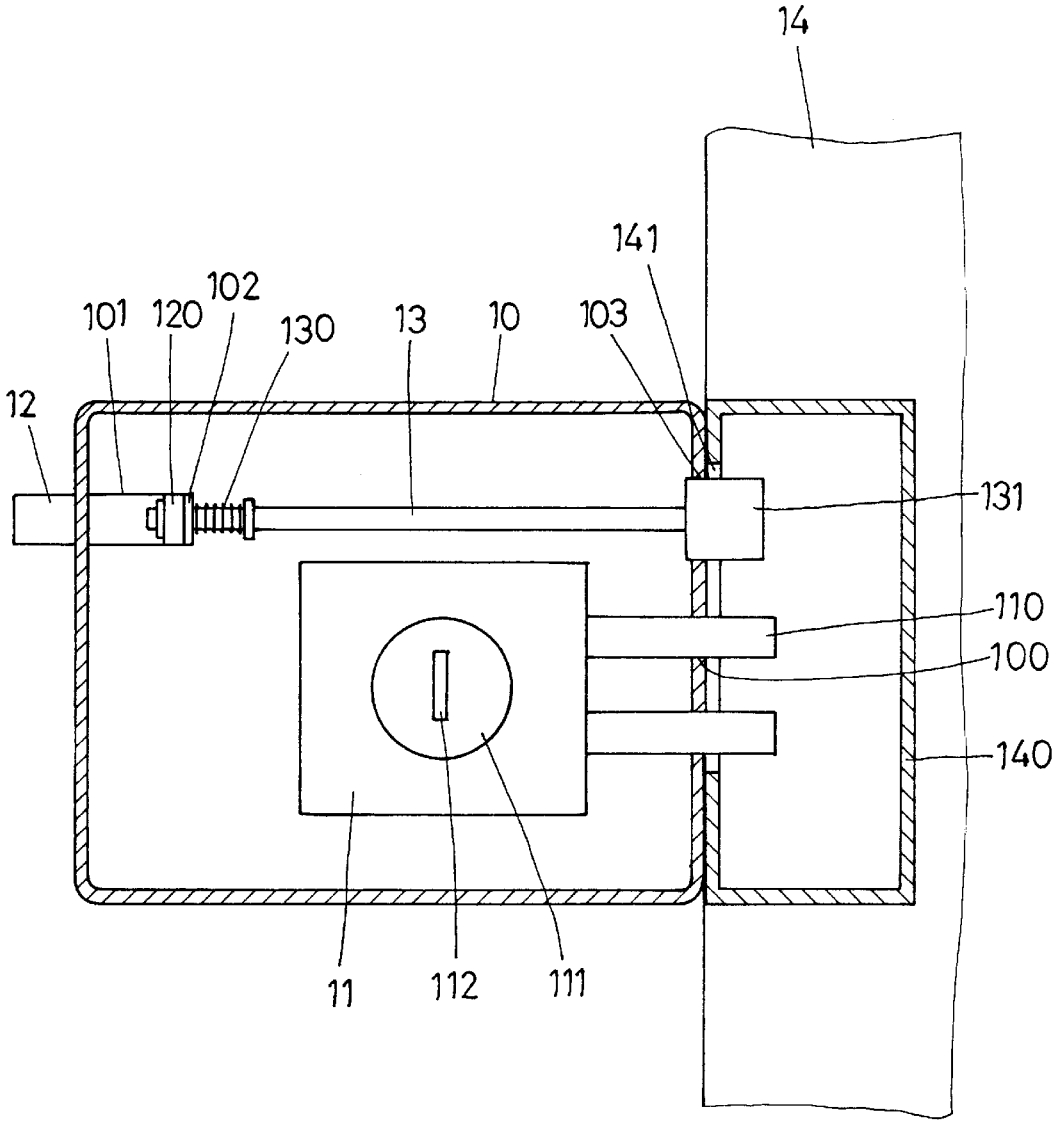
FIG.1 (PRIOR ART)
FIG. 1 is a schematic sectional view of a conventional door lock.
Figure 2:
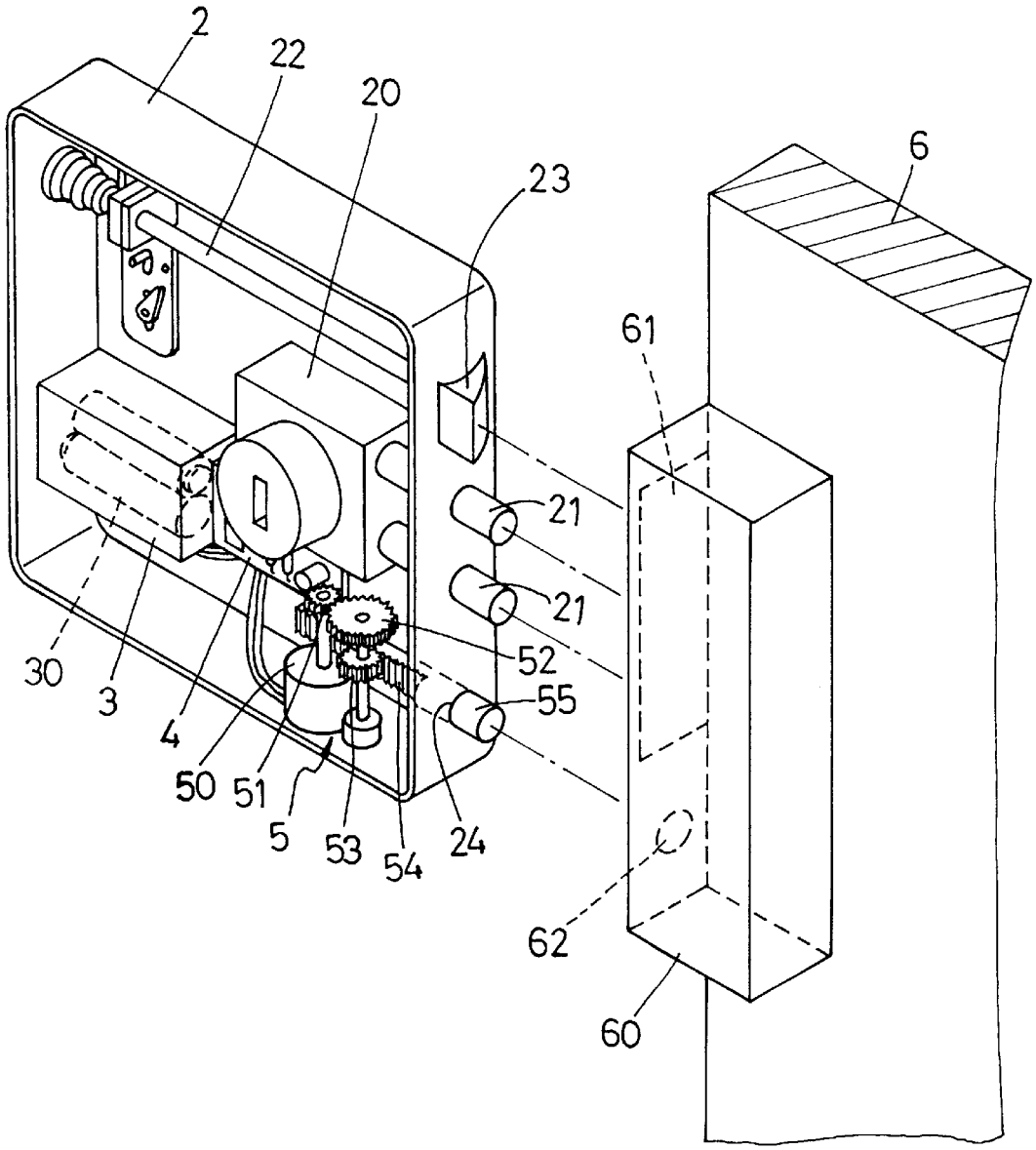
FIG. 2 is a perspective view of a remote-controlled door lock in the present invention, showing a battery base, a circuit board and a bolt-locking device disposed in a case body.

A preferred embodiment of a remote-controlled door lock in the present invention, as shown in FIG. 2, mainly includes a case body 2 and a strike base 60.

The case body 2 has a lock base 20 and a latch-bolt assembly 22 disposed therein. The lock base 20 has dead bolts 21 capable of extending out of a sidewall of the case body 2. The latch-bolt assembly 22 has an engagement block 23 disposed at one end thereof and capable of extending out of the sidewall of the case body 2.

The case body 2 further has a battery base 3, a circuit board 4 and a bolt-locking device 5 disposed therein. The battery base 3 can accommodate batteries 30 therein. The bolt-locking device 5 has a motor 50, a driving gear 51 disposed at an upper end of the motor 50, a driven gear 52 meshed with the driving gear 51, a transmission gear 53 coaxially disposed below the driven gear 52, a gear rack 54 meshed with the transmission gear 53, and a bolt rod 55 disposed at a front portion of the gear rack 54 and capable of extending out of a through hole 24 formed in the sidewall of the case body 2.

The strike base 60 installed in a doorframe 6 has an elongated opening 61 and an engagement hole 62 respectively formed in a sidewall thereof. The elongated opening 61 is disposed for corresponding in location to be aligned with the dead bolts 21 of the lock base 20 and the engagement block 23 of the latch-bolt assembly 22. The engagement hole 62 is disposed for corresponding in location to be aligned with the bolt rod 55 of the bolt-locking device 5.

In locking, when the circuit board 4 receives a locking sign from a remote controller (not shown), the circuit board 4 will actuate the motor 50 of the bolt-locking device 5 to turn counterclockwise to make the driving gear 51 to rotate the driven gear 52 clockwise so that the transmission gear 53 coaxially rotated with the driven gear 52 in the same direction will force the gear rack 54 to move outwardly to make the bolt rod 55 of the bolt-locking device 5 extending out of the through hole 24 of the case body 2 to be inserted into and engaged with the engagement hole 62 of the strike base 60 so as to have a door plate (not shown) locked in a limited position, by which when the door plate is locked with the bolt rod 55 of the bolt-locking device 5 still engaged with the engagement hole 62 of the strike base 60, the door plate is unable to be completely unlocked only by a key (not shown) to unlock the dead bolts 21 of the lock base 20 and the engagement block 23 of the latch-bolt assembly 22 without using the remote controller to actuate the bolt rod 55 of the bolt-locking device 5 to be disengaged from the engagement hole 62 of the strike base 60, thus achieving a best effect of anti-theft.

In unlocking, when the circuit board 4 receives an unlocking sign from the remote controller, the circuit board 4 will actuate the motor 50 to turn clockwise to make the driving gear 51 to rotate the driven gear 52 counterclockwise so that the transmission gear 53 coaxially rotated with the driven gear 52 in the same direction will force the gear rack 54 to move inwardly to make the bolt rod 55 of the bolt-locking device 5 disengaged from the engagement hole 62 of the strike base 60 and moving back into the case body 2, by which the door plate can be completely unlocked after using the key to unlock the dead bolts 21 of the lock base 20 and the engagement block 23 of the latch-bolt assembly 22.

Figure 3:
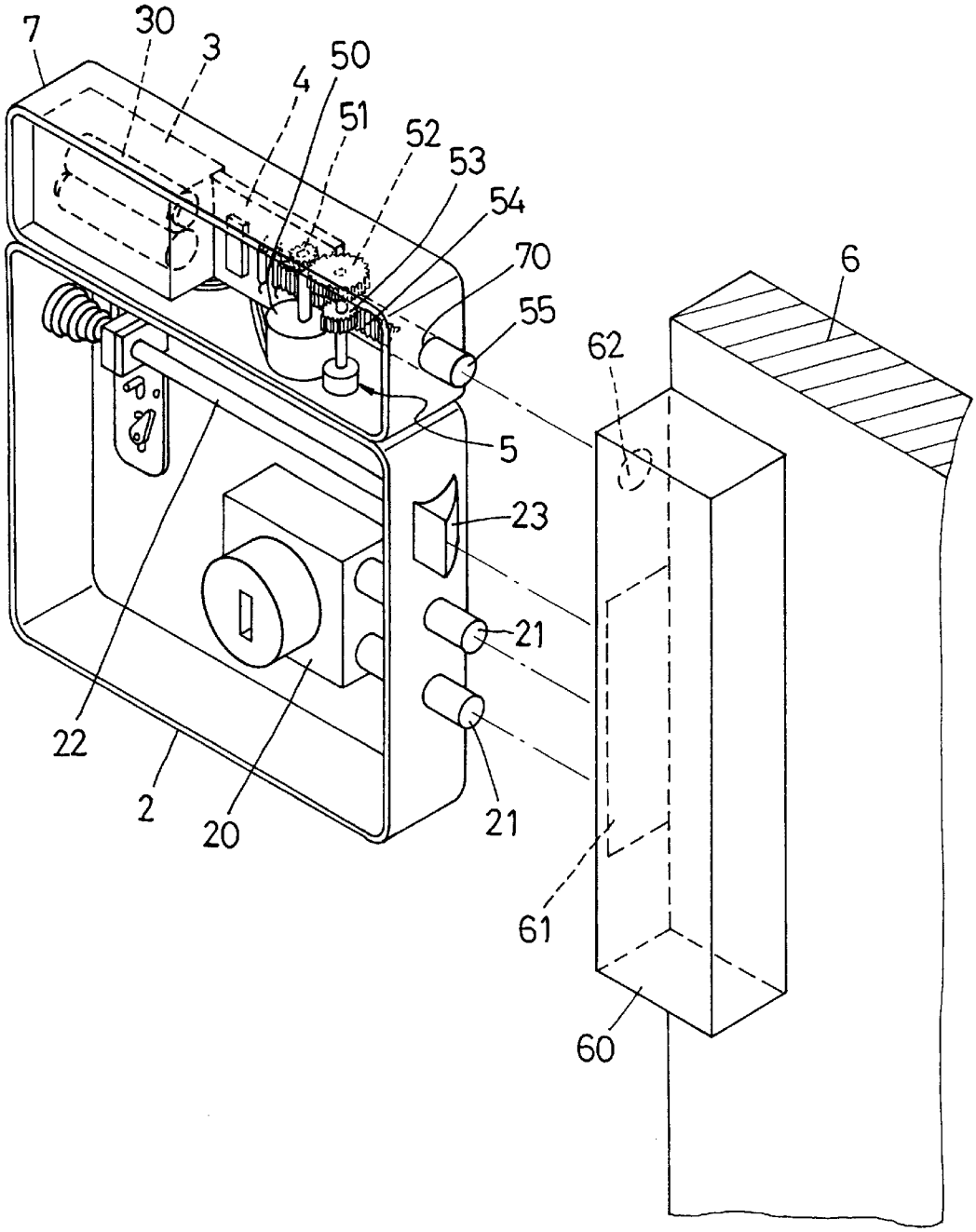
FIG. 3 is a perspective view of the remote-controlled door lock in the present invention, showing the battery base, the circuit board and the bolt-locking device disposed in a control case secured above the case body.
Figure 4:
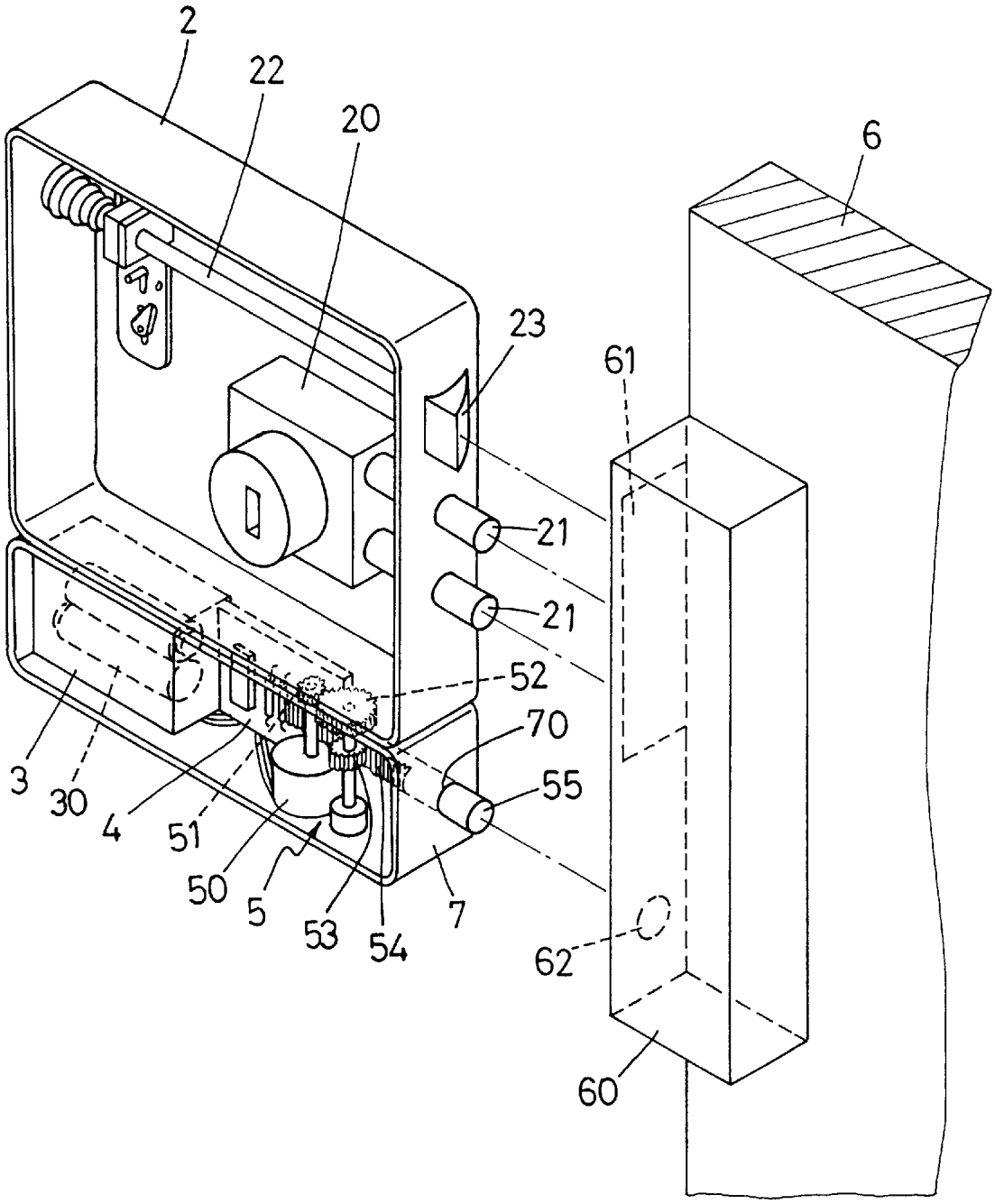
FIG. 4 is a perspective view of the remote-controlled door lock in the present invention, showing the battery base, the circuit board and the bolt-locking device disposed in the control case secured below the case body; and, FIG. 5 is a perspective view of the remote-controlled door lock in the present invention, showing the battery base, the circuit board and the bolt-locking device disposed in a strike base installed in a doorframe.

Besides, the battery base 3, the circuit board 4 and the bolt-locking device 5 of the case body 2 can be disposed in a control case 7. The control case 7 can be firmly secured above the case body 2 (as shown in FIG. 3) or below the case body 2 (as shown in FIG. 4). The bolt rod 55 of the bolt-locking device 5 disposed in the case control 7 is capable of extending out of a through hole 70 formed in a sidewall of the case control 7. The engagement hole 62 formed in the sidewall of the strike base 60 is disposed for corresponding in location to be aligned with the bolt rod 55 of the bolt-locking device 5. When the circuit board 4 receives a locking sign from the remote controller, the circuit board 4 will actuate the motor 50 to turn the driving gear 51 to rotate the driven gear 52 so that the transmission gear 53 coaxially rotated with the driven gear 52 in the same direction will force the gear rack 54 to move outwardly to make the bolt rod 55 of the bolt-locking device 5 extending out of the through hole 70 of the control case 7 to be inserted into and engaged with the engagement hole 62 of the strike base 60, by which the door plate is locked in a limited position.

Figure 5:
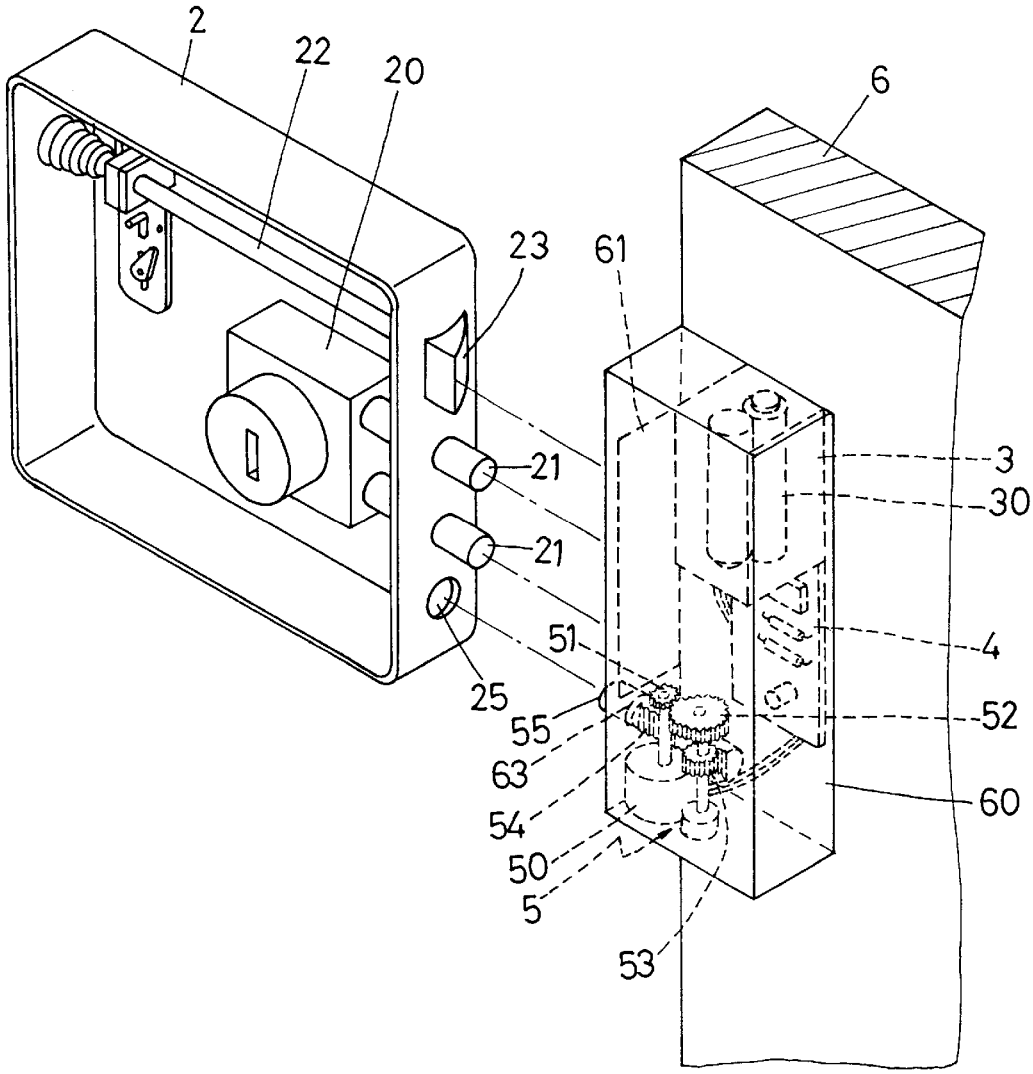

Moreover, the battery base 3, the circuit board 4 and the bolt-locking device 5 of the case body 2 can be disposed in the strike base 60 of the doorframe 6 (as shown in FIG. 5). The bolt rod 55 of the bolt-locking device 5 disposed in the strike base 60 is capable of extending out of a through hole 63 formed in a sidewall of the strike base 60. An engagement hole 25 is formed in the sidewall of the case body 2 for corresponding in location to be aligned with the bolt rod 55 of the bolt-lockingdevice 5.

In locking, when the circuit board 4 receives a locking sign from the remote controller, the circuit board 4 will actuate the motor 50 to turn clockwise to make the driving gear 51 to rotate the driven gear 52 counterclockwise so that the transmission gear 53 coaxially rotated with the driven gear 52 in the same direction will force the gear rack 54 to move outwardly to make the bolt rod 55 of the bolt-locking device 5 extending out of the through hole 63 of the strike base 60 to be inserted into and engaged with the engagement hole 25 of the case body 2 so as to have the door plate locked in a limited position, by which when the door plate is locked with the bolt rod 55 of the bolt-locking device 5 still engaged with the engagement hole 25 of the case body 2, the door plate is unable to be completely unlocked only by the key to unlock the dead bolts 21 of the lock base 20 and the engagement block 23 of the latch-bolt assembly 22 without using the remote controller to actuate the bolt rod 55 of the bolt-locking device 5 to be disengaged from the engagement hole 25 of the case body 2, thus achieving a best effect of anti-theft.

In unlocking, when the circuit board 4 receives an unlocking sign from the remote controller, the circuit board 4 will actuate the motor 50 to turn counterclockwise to make the driving gear 51 to rotate the driven gear 52 clockwise so that the transmission gear 53 coaxially rotated with the driven gear 52 in the same direction will force the gear rack 54 to move inwardly to make the bolt rod 55 of the bolt-locking device 5 disengaged from the engagement hole 25 of the case body 2 and moving back into the strike base 60, by which the door plate can be completely unlocked after using the key to unlock the dead bolts 21 of the lock base 20 and the engagement block 23 of the latch bolt assembly 22.

While the preferred embodiment of the invention has been described above, it will be recognized and understood that various modifications may be made therein and the appended claims are intended to cover all such modifications that may fall within the spirit and scope of the invention.

What is claimed is:

1. A remote-controlled door lock comprising:

a case body having a lock base and a latch-bolt assembly disposed therein, said lock base having at least one dead bolt capable of extending out of a sidewall of said case body, said latch-bolt assembly having an engagement block disposed at one end thereof and capable of extending out of said sidewall of said case body;

a strike base installed in a doorframe and having an elongated opening; and, characterized in that a battery base, a circuit board and a bolt-locking device of said case body are disposed in a control case firmly secured above said case body, and said bolt rod of said bolt-locking device is capable of extending out of a through hole formed in a sidewall of said control case; and, wherein said engagement hole formed in said sidewall of said strike base is disposed for corresponding in location to be aligned with said bolt rod of said bolt-locking device.

said bolt-locking device having a motor, a driving gear disposed at an upper end of said motor, a driven gear meshed with said driving gear, a transmission gear coaxially disposed below said driven gear, a gear rack meshed with said transmission gear, and a bolt rod disposed at a front portion of said gear rack and capable of extending out of the through hole formed in a sidewall of said control case;

said strike base having an engagement hole formed in a sidewall thereof for corresponding in location to be aligned with said bolt rod of said bolt-locking device; and, whereby in locking, when said circuit board receives a locking sign from a remote controller, said circuit board will actuate said motor to turn said driving gear to rotate said driven gear so that said transmission gear coaxially rotated with said driven gear in the same direction will force said gear rack to move outwardly to be inserted into and engaged with said engagement hole of said strike base so as to have a door plate locked in a limited position, by which when said door plate is locked with said bolt rod of said bolt-locking device still engaged with said engagement hole of said strike base, said door plate is unable to be completely unlocked only by a key to unlock said dead bolts of said lock base and said engagement block of said latch-bolt assembly without using said remote controller to actuate said bolt rod of said bolt-locking device to be disengaged from said engagement hole of said strike base, thus achieving a best effect of anti-theft; in unlocking, when said circuit board receives and unlocking sign from said remote controller, said circuit board will actuate said motor to turn reversely to make said driving gear to rotate said driven gear so that said transmission gear coaxially rotated with said driven gear in the same direction will force said gear rack to move inwardly to make said bolt rod of said bolt-locking device disengaged from said engagement hole of said strike base and moving back into said case body, by which said door plate can be completely unlocked after using said key to unlock said dead bolts of said lock base and said engagement block of said latch-bolt assembly.

* * * * *